US008613641B2

(12) United States Patent
Sasu et al.

(10) Patent No.: US 8,613,641 B2
(45) Date of Patent: Dec. 24, 2013

(54) CHANNEL INLET EDGE DEBURRING FOR GAS DIFFUSER CASES

(75) Inventors: Ioan Sasu, Brossard (CA); Gaetan Boisclair, Longueuil (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1162 days.

(21) Appl. No.: 12/255,838

(22) Filed: Oct. 22, 2008

(65) Prior Publication Data

US 2010/0099335 A1 Apr. 22, 2010

(51) Int. Cl.
*B24B 1/00* (2006.01)

(52) U.S. Cl.
USPC ..... 451/38; 451/39; 451/61; 451/76; 451/97

(58) Field of Classification Search
USPC ..... 451/36, 38, 39, 40, 61, 76, 82, 86, 91, 451/97
See application file for complete search history.

(56) References Cited

U.S. PATENT DOCUMENTS

| | | | | |
|---|---|---|---|---|
| 3,109,262 | A | 11/1963 | Weaver et al. | |
| 3,482,423 | A | 12/1969 | Murray et al. | |
| 3,668,913 | A | 6/1972 | Morris | |
| 4,426,867 | A | 1/1984 | Neal et al. | |
| 4,428,213 | A | 1/1984 | Neal et al. | |
| 4,454,740 | A | 6/1984 | Neal et al. | |
| 4,689,921 | A | 9/1987 | Murate et al. | |
| 4,848,122 | A | 7/1989 | Sullivan | |
| 4,931,120 | A * | 6/1990 | Christoff | 156/153 |
| 4,936,057 | A | 6/1990 | Rhoades | |
| 5,057,174 | A * | 10/1991 | Anderson et al. | 156/155 |
| 5,090,870 | A | 2/1992 | Gilliam | |
| 5,107,631 | A * | 4/1992 | Wern | 451/28 |
| 6,350,185 | B1 * | 2/2002 | Robins et al. | 451/76 |
| 6,386,949 | B1 * | 5/2002 | Hagiwara et al. | 451/40 |
| 6,490,899 | B2 | 12/2002 | Berthelet et al. | |
| 6,520,838 | B1 | 2/2003 | Shaw | |
| 6,568,994 | B1 | 5/2003 | Shaw | |
| 6,699,109 | B1 | 3/2004 | Fox et al. | |
| 6,745,955 | B2 * | 6/2004 | Kronz | 239/227 |
| 6,764,384 | B1 | 7/2004 | Kleer et al. | |
| 6,783,433 | B2 | 8/2004 | Hokkirigawa et al. | |
| 6,837,085 | B2 | 1/2005 | Berthelet et al. | |
| 6,988,935 | B2 * | 1/2006 | Shiraishi et al. | 451/38 |
| 7,063,593 | B2 * | 6/2006 | Carpenter | 451/36 |
| 7,144,302 | B2 | 12/2006 | Bolz et al. | |
| 7,389,663 | B2 * | 6/2008 | Cheppe et al. | 72/53 |
| 7,789,966 | B2 * | 9/2010 | Kramer et al. | 134/8 |
| 8,016,642 | B2 * | 9/2011 | Kuroiwa et al. | 451/38 |
| 2004/0162009 | A1 * | 8/2004 | Carpenter | 451/39 |
| 2007/0050977 | A1 | 3/2007 | Werner | |
| 2007/0178810 | A1 * | 8/2007 | Choi et al. | 451/38 |
| 2009/0233531 | A1 * | 9/2009 | Kuroiwa et al. | 451/66 |

* cited by examiner

*Primary Examiner* — Eileen P. Morgan
(74) *Attorney, Agent, or Firm* — Norton Rose Fulbright Canada LLP

(57) ABSTRACT

A method of deburring channel inlet edges inside a cavity of a gas diffuser case is disclosed. The diffuser case has a plurality of channels each having an inner surface and an inlet edge defining an inlet of the channel. The surfaces of adjacent channels co-operate to provide said inlet edge therebetween. The inlet edges of the channels are provided in an inwardly facing circular array around a central axis of the gas diffuser case. The method comprises: inserting a tool head having at least one nozzle in the cavity of the gas diffuser case; and then ejecting abrasive particles from at least one nozzle towards at least one of the channel inlet edges of the gas diffuser case to at least one of decrease a radius of at least one said edge and improve a smoothness of at least one said surface.

7 Claims, 10 Drawing Sheets

22

CHANNEL INLET EDGE DEBURRING FOR GAS DIFFUSER CASES

TECHNICAL FIELD

The technical field generally relates to centrifugal compressor diffusers, and in particular, to the manufacturing of gas diffuser cases therefor.

BACKGROUND

A gas diffuser case for use in collecting compressed gas ejected from a centrifugal compressor generally comprises a plurality of internal channels known as diffuser passages. Each channel has an inlet axis which is somewhat tangential to the compressor's rotational axis, and is thus oriented in a direction to receive the compressed gas ejected from the compressor.

In many applications, the acute angle which forms the edge between adjacent channel inlets requires a very small radius at its tip and a very smooth surface to provide optimal efficiency for the compressor-diffuser assembly. Providing such radius and surface, however, can be challenging and room for improvement exists.

SUMMARY

In one aspect, the present concept provides a method of deburring channel inlet edges inside a cavity of a gas diffuser case, the diffuser case having a plurality of channels each having an inner surface and an inlet edge defining an inlet of the channel, the surfaces of adjacent channels co-operating to provide said inlet edge therebetween, the inlet edges of the channels being provided in an inwardly facing circular array around a central axis of the gas diffuser case, the method comprising: inserting a tool head having at least one nozzle in the cavity of the gas diffuser case; and then ejecting abrasive particles from the at least one nozzle towards at least one of the channel inlet edges of the gas diffuser case to at least one of decrease a radius of at least one said edge and improve a smoothness of at least one said surface.

In another aspect, the present concept provides a system for deburring channel inlet edges circumferentially disposed inside a circular cavity of a gas diffuser case, the system comprising: a tool head having at least one nozzle at an outer periphery of the tool head, the tool head configured for insertion inside the gas diffuser case, the at least one nozzle of the tool head configured to be directed substantially coaxially with an inlet channel of the gas diffuser case; a source of abrasive particles, the source in fluid communication with the at least one nozzle of the tool head; and an apparatus for forcing the particles out of the at least one nozzle of the tool head.

In another aspect, the present concept provides a method of providing a diffuser case, the diffuser case having a plurality of channels each having an inner surface and an inlet edge defining an inlet of the channel, the surfaces of adjacent channels co-operating to provide one said edge therebetween, the inlet edges of the channels being provided in an inwardly facing circular array around a central axis of the diffuser case, the method comprising the steps of: providing a plurality of said channels in the diffuser case, the step of providing causing machining burrs to form on said edges; and then directing a flow of abrasive particles radially outwardly towards the channel inlet edges of the diffuser case to remove the burrs and thereby deburr the inlets.

Further details of these and other aspects will be apparent from the following detailed description and appended figures.

BRIEF DESCRIPTION OF THE FIGURES

FIGS. 11 and 12 show another example of a tool head of a system for performing the deburring, in which FIG. 11 is a schematic axial cross-section view, taken along line 11-11 in FIG. 12, and FIG. 12 is a schematic radial cross-section view, taken along line 12-12 in FIG. 11;

FIGS. 15 and 16 show another example of a tool head of a system for performing the deburring, in which FIG. 15 is a schematic axial cross-section view, taken along line 15-15 in FIG. 16, and FIG. 16 is a schematic radial cross-section view taken along line 16-16 in FIG. 15; and FIGS. 17 and 18 show another example of a tool head of a system for performing the deburring, in which FIG. 17 is a schematic axial cross-section view, taken along line 17-17 in FIG. 18, and FIG. 18 is a schematic radial cross-section view taken along line 18-18 in FIG. 17.

DETAILED DESCRIPTION

Figure 1:
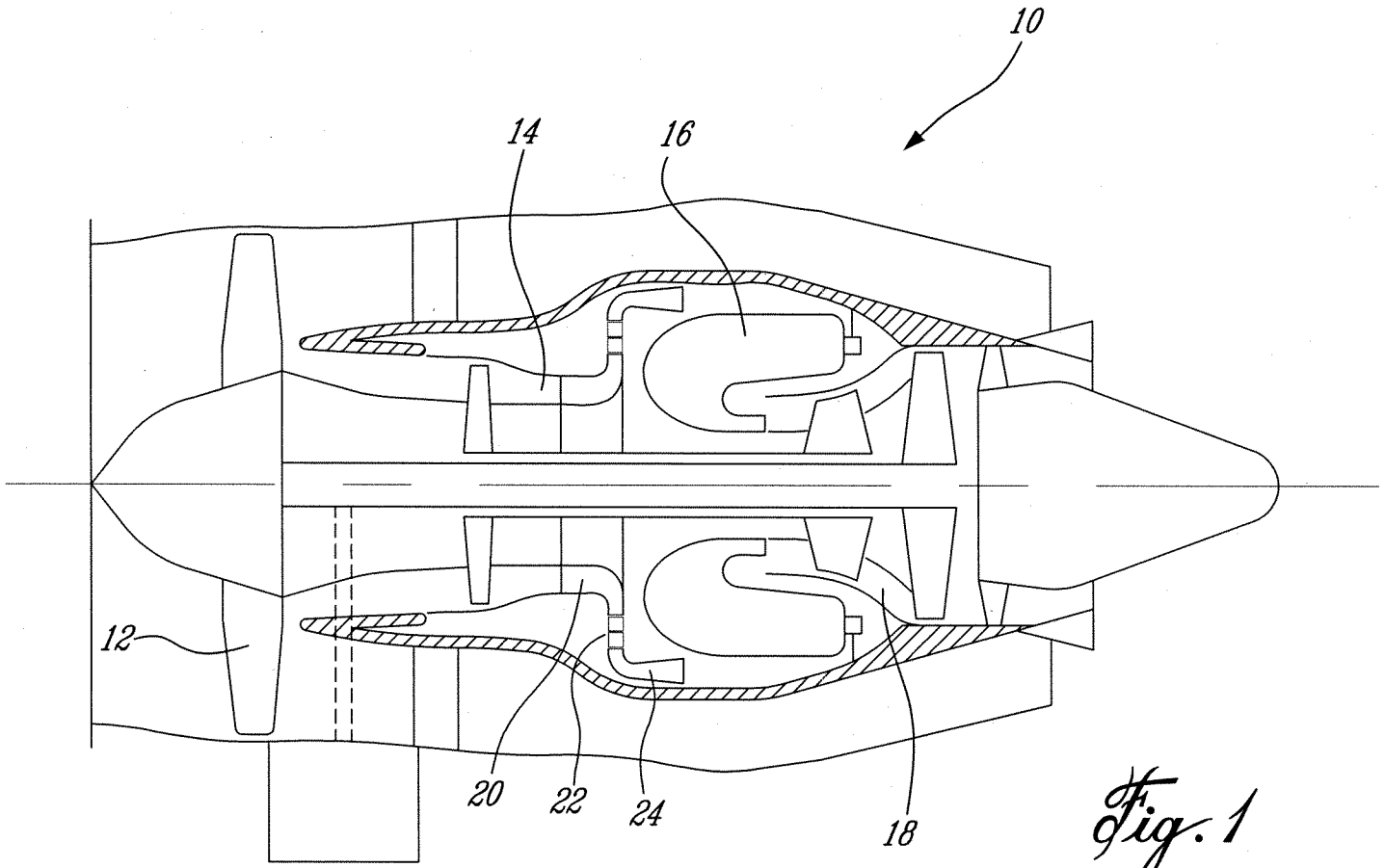
FIG. 1 schematically shows a generic gas turbine engine to illustrate one among numerous examples of environments in which a gas diffuser case can be used.

FIG. 1 illustrates an example of a gas turbine engine 10 generally comprising in serial flow communication a fan 12 through which ambient air is propelled, a multistage compressor section 14 for pressurizing the air, a combustor 16 in which the compressed air is mixed with fuel and ignited for generating an annular stream of hot combustion gases, and a turbine section 18 for extracting energy from the combustion gases. The compressor section 14 includes a centrifugal compressor 20 from which air exits in a substantially tangential direction at the outer periphery thereof when the engine 10 is operated. Air coming out of the centrifugal compressor 20 immediately enters channels inside a gas diffuser case 22 surrounding its outer periphery, which gas diffuser case 22 is schematically illustrated in FIG. 1. The illustrated example also shows diffuser pipes 24 receiving the air from channel outlets around the gas diffuser case 22.

It should be noted that a gas turbine engine is only one example among numerous possible environments in which a gas diffuser case can be used. Therefore, the techniques presented herein are not limited to gas diffuser cases for gas turbine engines.

Figure 2:
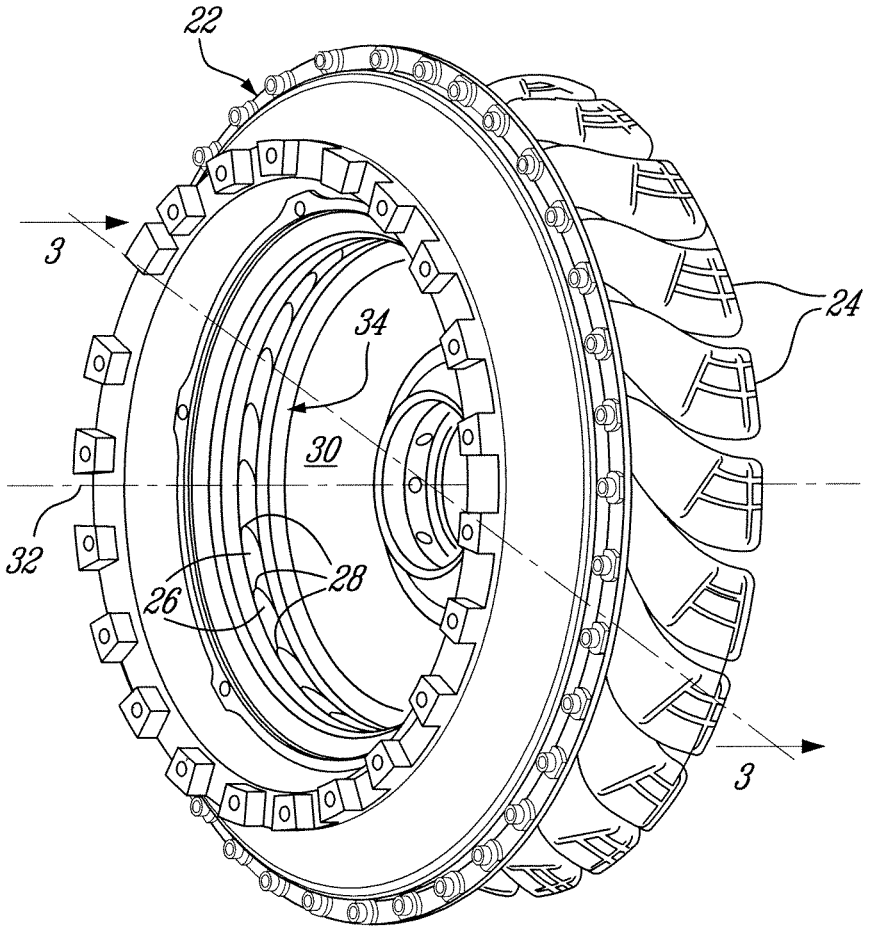
FIG. 2 is an isometric view showing an example of a gas diffuser case, the example including diffuser pipes connected around the gas diffuser case.

FIG. 2 is an isometric view showing an example of a gas diffuser case 22. The illustrated example is for use in a gas turbine engine. The gas diffuser case 22 is shown with an example of a diffuser pipe model. A plurality of these gas diffuser pipes 24 are bolted or otherwise fastened at the outer periphery of the gas diffuser case 22. Each diffuser pipe 24 has an inlet in registry with an outlet of a corresponding one among a plurality of channels 26 inside the gas diffuser case 22. The channels 26 have inlets which are defined by peripheral edges 28. It should be noted, however, that other arrangements are possible. For instance, it is possible to provide a plenum chamber surrounding the gas diffuser case 22 instead of using diffuser pipes.

FIG. 2 also shows the generally circular cavity 30 inside which the rotating device, for instance the centrifugal compressor 20 depicted in FIG. 1, is located once the gas diffuser case 22 is set in a machine. The rotation axis of the rotating device is then coincident with the central axis 32 of the cavity 30 of the gas diffuser case 22. The outer periphery of the rotating device is also very close to the channel inlet edges 28 inside the cavity 30 of the gas diffuser case 22. These edges 28 are located in an annular section 34 inside the cavity 30 of the gas diffuser case 22.

Figure 3:
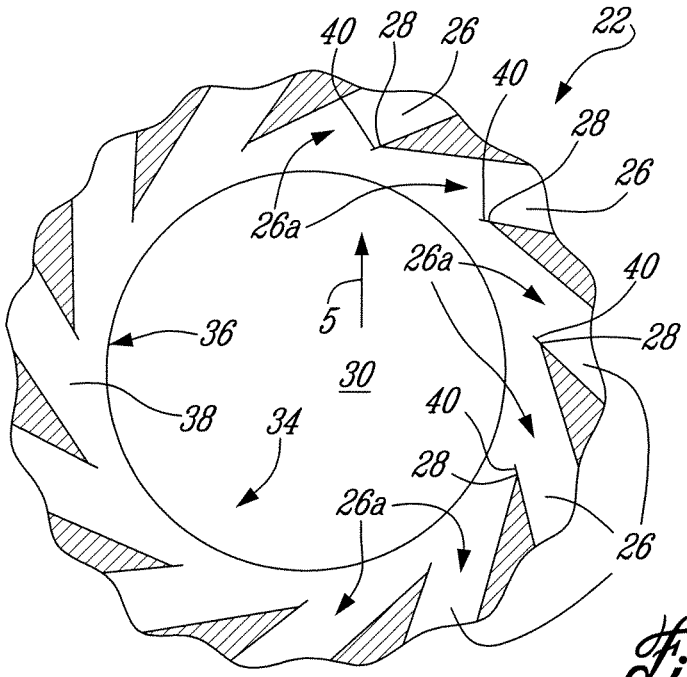
FIG. 3 is a schematic radial cross-section view, taken generally along line 3-3 in FIG. 2, showing the channels inside the gas diffuser case and the channel inlet edges before deburring.

FIG. 3 is a schematic radial cross-section view of the annular section 34 of the gas diffuser case 22 before deburring. As can be seen, each channel 26 has a corresponding inlet 26*a*. In the illustrated example, the channel inlet edges 28 form a circular array around the annular section 34. They are also farther from the center of the cavity 30 than the inner edge 36 of the spaced-apart walls 38 (only one of which is shown in FIG. 3) delimiting the annular section 34. Each of the edges 28 may have, during manufacturing, burrs 40 resulting from a previous manufacturing stage of the gas diffuser case 22 and which are generally desirable to remove.

Furthermore, the smoothness of the inners surfaces of adjacent channels 26 which defining the edges 28 may need to be improved so as to lower the drag, thereby maximizing the efficiency of the centrifugal compressor.

Figure 4:
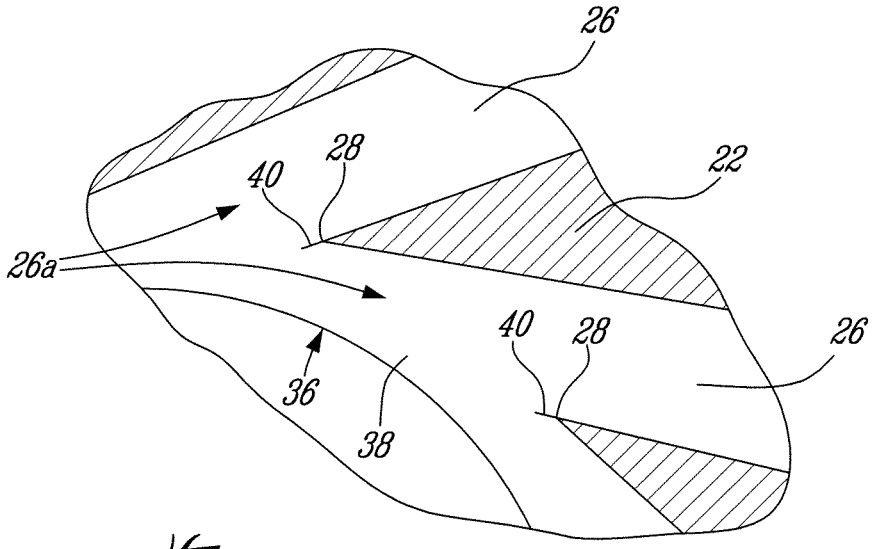
FIG. 4 is an enlarged view showing two of the channel inlet edges in FIG. 3.

FIG. 4 is an enlarged view showing an example of burrs 40.

Figure 5:
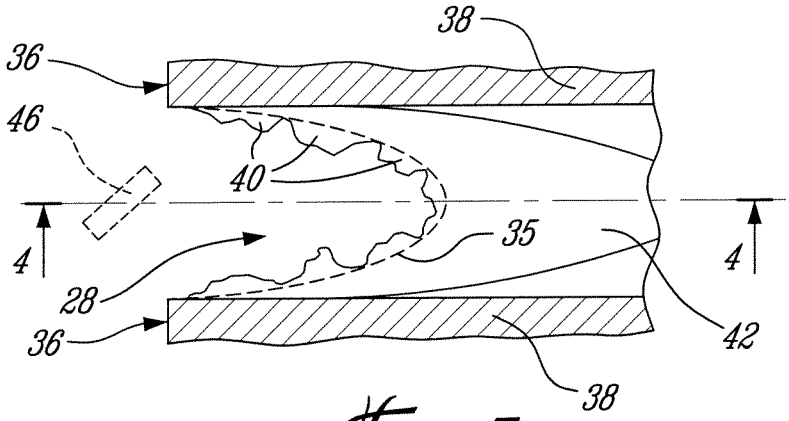
FIG. 5 is a schematic view showing a portion of one of the channel inlet edges, as viewed from a radial direction depicted by arrow 5 in FIG. 3.

FIG. 5 is a schematic view showing one of the channel inlets 28, as viewed from the radial direction depicted by arrow 5 in FIG. 3. This figure shows that each edge 28 may have a plurality of irregular burrs 40 of various sizes and shapes. The spaced-apart walls 38 and their inner edge 36 are shown in FIG. 5. It also shows that the edges 28 may have a non-linear profile, such a parabolic profile. Other kinds of profiles are possible as well. The stippled line 35 shows the target dimensions of the edge 28 after deburring. Moreover, the width of diffuser case material between the surfaces 42 on either side of the edge 28, may progressively increase immediately downstream the tip of the edge 28.

Figure 6:
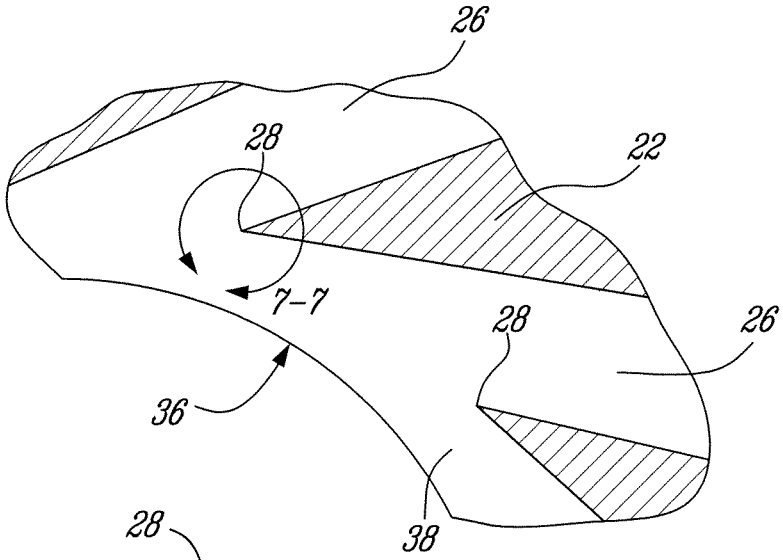
FIG. 6 is a view similar to FIG. 4, showing the channel inlet edges after a rough deburring.

The deburring may first include a rough deburring stage where pieces of larger burrs 40 on at least some of the channel inlet edges 28 are removed, for instance by using a hand tool or another machine (schematically depicted as 46 in FIG. 5) in preparation of a deburring stage described hereafter. This may result in something as shown in FIG. 6. Tools can include, for instance, files, plies, etc.

Figure 7:
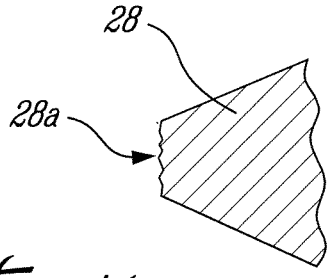
FIG. 7 is an enlarged view of one of the channel inlet edges shown in FIG. 6.
Figure 8:
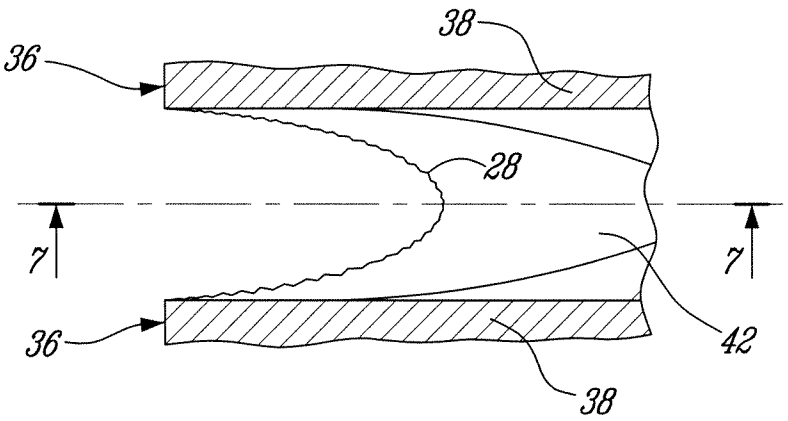
FIG. 8 is a view similar to FIG. 5, showing the channel inlet edge after the rough deburring.

Generally, large burrs 40 are very thin and are easy to remove. They are also very sharp. They thus have a radius of curvature at their tip that is relatively small. However, the removal of large burr pieces in the rough deburring often substantially flattens the tip 28*a* of the edges 28 and therefore, they may loose their sharpness, as shown for instance in FIG. 7, where the tip 28*a* of the edge 28 is almost flat. The rough deburring, however, brings the dimensions of the edges 28 close or on the target, as shown in FIG. 8, where the dimensions of the edge 28 corresponds approximately to the target depicted by the stippled line 35 in FIG. 5. However, as aforesaid, the edge 28 in FIG. 8 is dull and the smoothness of the surfaces surrounding the edge 28, for instance the surfaces 42 on each side, may need to be improved.

Figure 9:
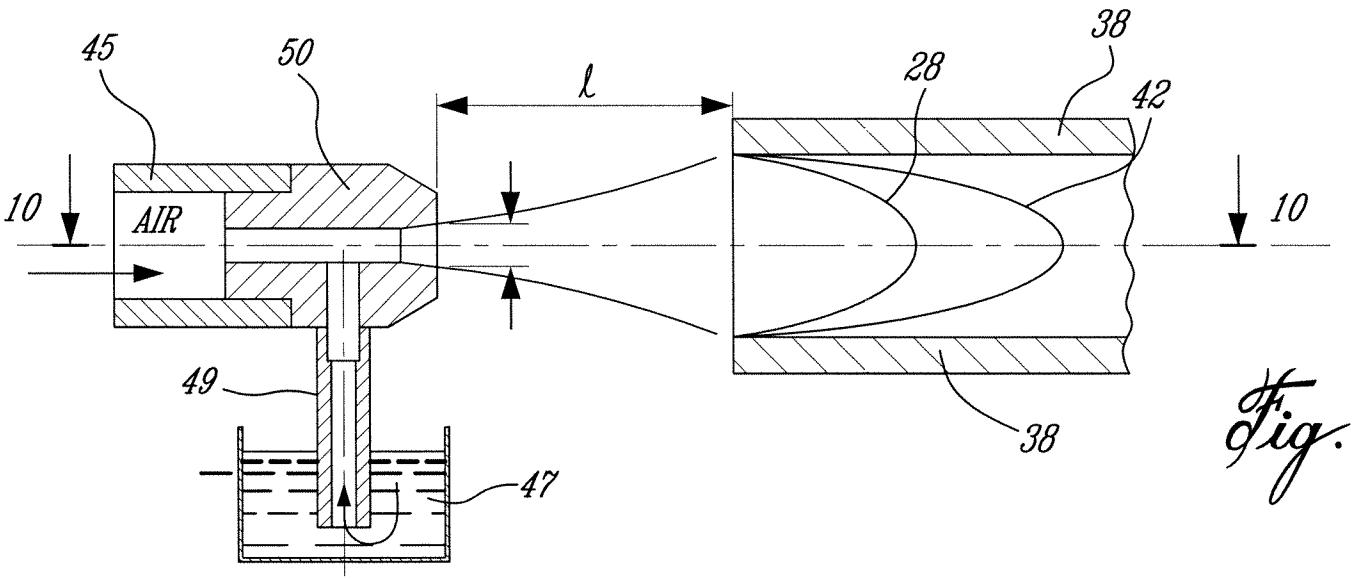
FIG. 9 is a schematic axial cross-section view of an example of a system for performing deburring.
Figure 10:
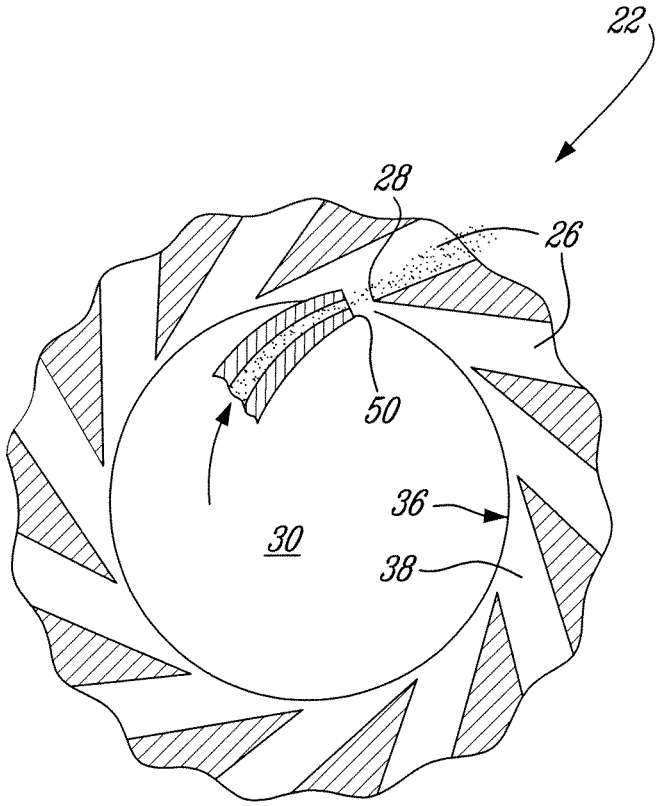
FIG. 10 is a schematic radial cross-section view, taken along line 10-10 in FIG. 9, showing schematically the deburring of one of the channel inlet edges.

FIGS. 9 and 10 are schematic views depicting an example of the deburring for the channel inlet edges 28. The deburring is done by impinging particles on the edges 28, the particles being ejected from one or more nozzles 50 (only one being shown in FIGS. 9 and 10) in a direction that is substantially parallel to an inlet axis of the channel—i.e. in substantially the same direction that, in use, gases exiting at the centrifugal compressor would enter the inlets of channels 26 of the gas diffuser case 22. Typically, this direction will be more or less in a tangential direction relative to the diffuser case circumference, since the air exit in compressor will be generally tangentially oriented.

Particles used in the particle stream may be abrasive for removing some of the material on the edges 28. Abrasive particles can be dry or wet. Water and/or any other liquid may be used to wet the abrasive particles, for instance to improve the surface finish or to control the dust being generated by the particles.

There are different ways of imparting energy to the particles for the deburring. One is to use a compressed gas, for instance compressed air, as a substrate to carry the particles out of the nozzle or nozzles 50. Any suitable approach may be used. In FIG. 9, the compressed gas is supplied by a channel 45. FIG. 9 also shows a liquid 47 being supplied to the nozzle 50 by means of a tube 49. Wet particles then exit the nozzle 50 and will hit the edge 28, which edge 28 is as close as possible to the nozzle 50 (distance "I" being minimal). It should be noted that the distance "I" in FIG. 9 is not necessarily to scale.

Figure 11:
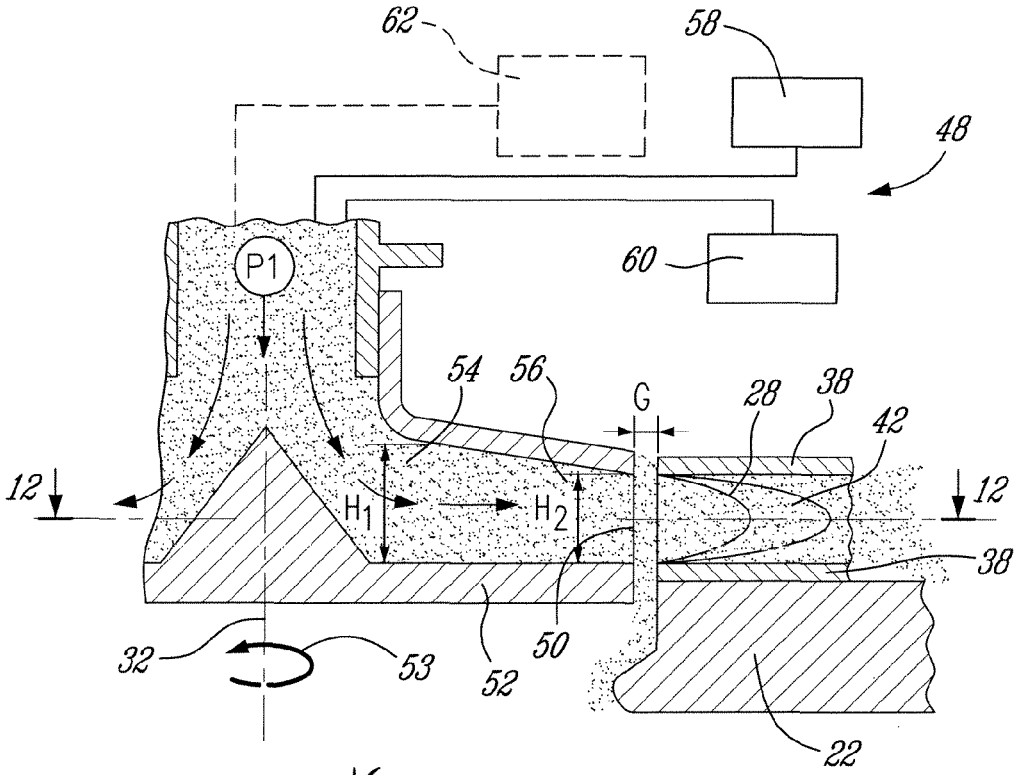
Figure 12:
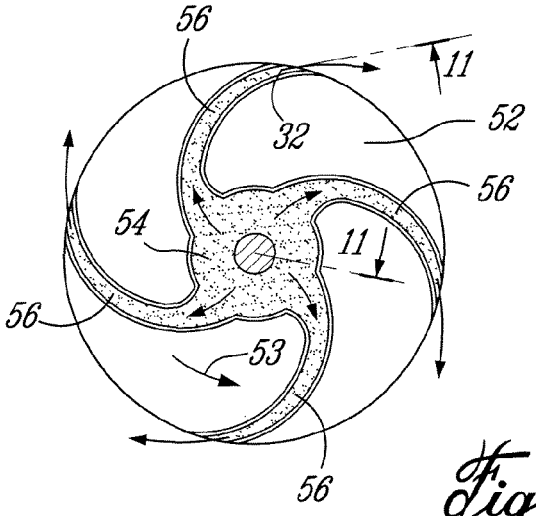

FIG. 11 shows an example of a system 48 having a tool head 52 carrying four nozzles 50. FIG. 12 is a schematic radial cross section view of the tool head 52. The tool head 52 comprises a central plenum 54 in fluid communication with internal conduits 56 leading to the nozzles 50 located at the outer periphery of the tool head 52. The plenum 54 is itself in fluid communication with a compressed gas source 58 and a particle source 60, as shown in FIG. 11. The plenum 54 can also be in fluid communication with a liquid source 62 for wetting the particles, if desired.

FIG. 12 shows that the system 48 has curved conduits 56 in the tool head 52 that are decreasing in height towards the periphery (from $H_1$ to $H_2$) so as to accelerate the stream of particles. The nozzle 50 of each conduit 56, as shown in FIG. 11, has a height $H_2$ approximately equal to the width of the edge 28. Also, the gap G between the outer periphery of nozzles 50 and the innermost portion of the edges 28 is as small as possible. The nozzles 50 may be configured and disposed to enter the annular section 34, the outer periphery of the nozzles 50 having a radial distance from the center of the cavity 30 that is greater than that of the inner edge 36, as shown in FIG. 11. This, along with the curvature of the conduits 56, impart to the stream of particles a direction that is as close as possible to the path of the gases as they leave the rotating device to be used with the gas diffuser case 22.

The time required for processing each edge 28 during the deburring will depend on many factors, for instance the hardness of the metal used for the channel inlet edges 28, the kind of particles, the velocity and density of the particles, the extent of the rough deburring, etc. The desired smoothness of the surfaces around the edges 28 and the target radius of curvature of the tip 28*a* of the edges 28 are other factors that may dictate the processing time. Thus, the deburring is completed only once the desired surface finish is obtained and the radius of curvature of the edges 28 is equal or smaller than the target value.

Figure 13:
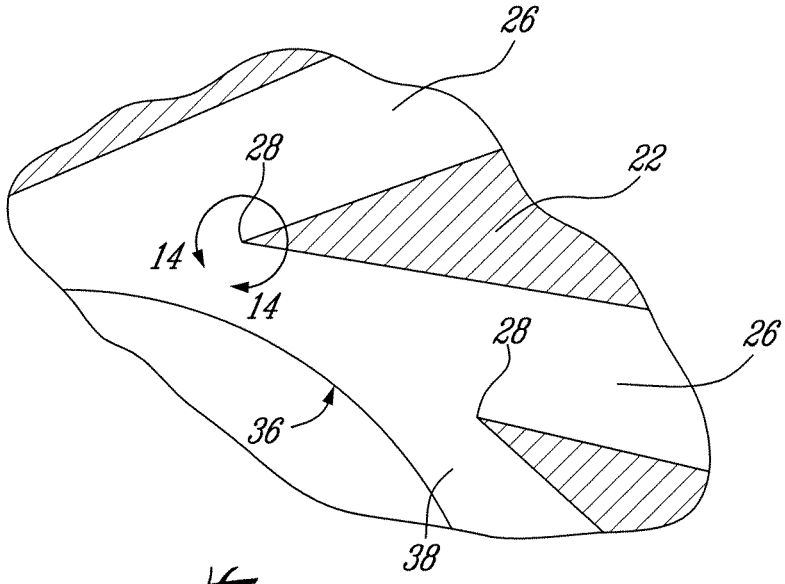
FIG. 13 is a view similar to FIG. 4, showing the channel inlet edges after the deburring.
Figure 14:
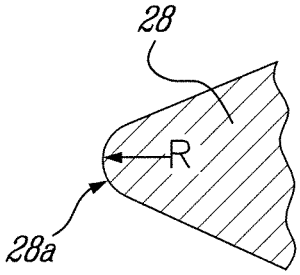
FIG. 14 is an enlarged view of one of the channel inlet edges shown in FIG. 13.

FIG. 13 shows two adjacent edges 28 after the deburring and FIG. 14 is an enlarged view of the tip 28*a* of one of these edges 28, which tip 28*a* has a radius R.

During the machining process, the tool head 52 of the system 48 can remain in a fixed position with reference to the edges 28 of the gas diffuser case 22 being deburred. The tool head 52 will then need to be repositioned if the number of nozzles 50 is lower than the number of edges 28 of the gas diffuser case 22. The gas diffuser case 22, which would then be held in a corresponding support or arrangement (not shown), can otherwise be pivoted until the corresponding edges 28 are in the right position with reference to the corresponding nozzle or nozzles 50 of the fixed tool head 52.

Another possibility is to allow the tool head 52 to rotate at high speeds within the cavity 30 of the gas diffuser case 22 during the deburring. The rotation can give the stream of particles a direction that is even closer to the direction of the gases during the operation of the gas diffuser case 22. This will also render unnecessary any angular repositioning between the tool head 52 and the edges 28 of the gas diffuser case 22. Referring back to FIGS. 11 and 12, the tool head 52 can be allowed to rotate freely around the central axis 32 using a supporting arrangement (not shown). The tool head 52 is driven by the jet effect created by the changes in direction of the compressed gas and the particle streams inside the tool head 52. The rotation direction is shown by arrow 53.

Figure 15:
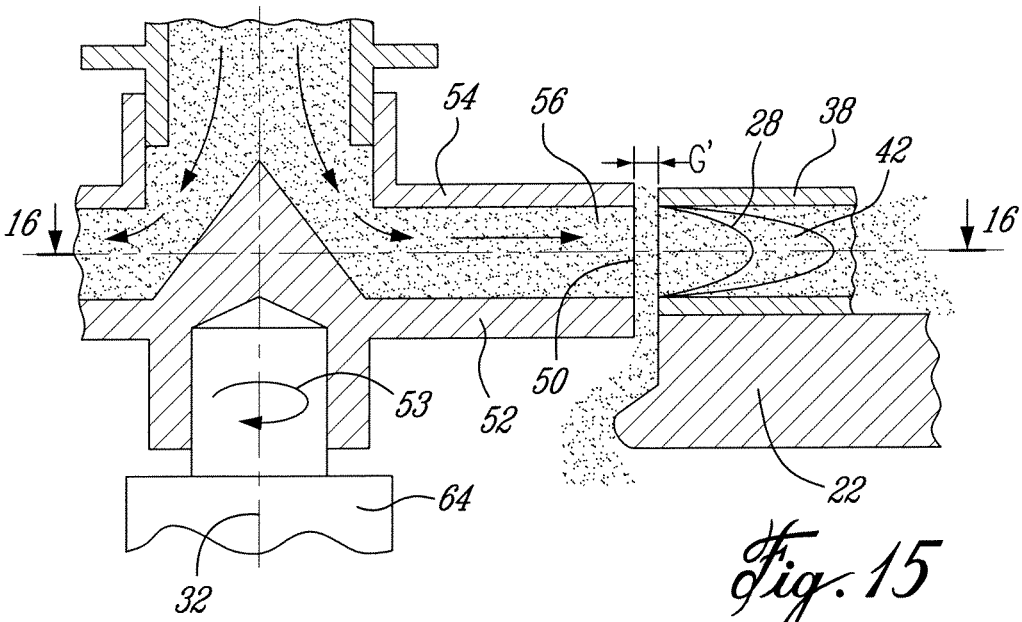
Figure 16:
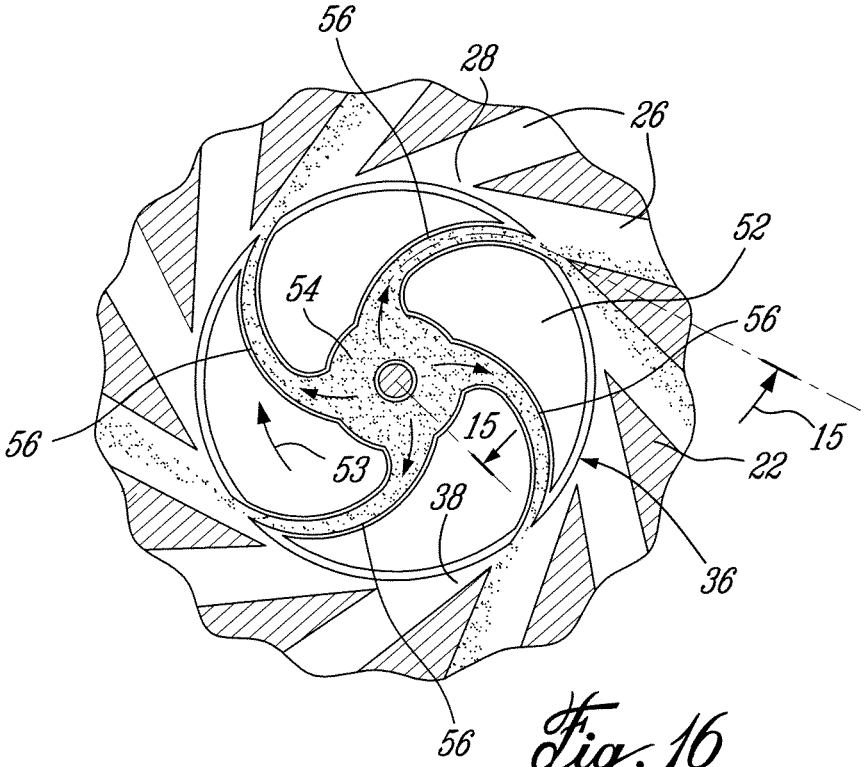

FIGS. 15 and 16 show another example of the system 48 for deburring. In this example, the tool head 52 is rotated at high speeds by a motor 64 in direction 53 and the stream of particles is ejected out through the nozzles 50 by the centrifugal effect. The direction 53 is opposite that of FIGS. 11 and 12.

If desired, the system 48 of FIGS. 15 and 16 can also be used with a compressed gas, for instance to eject the particles with more force and to prevent particles from accumulating somewhere in the gas diffuser case 22. Still, FIGS. 15 and 16 show that the conduits 56 in the tool head 52 can have a decreasing width in the radial plane (FIG. 16) and a constant height in the axial plane (FIG. 15). The tool head 52 illustrated in the example of FIGS. 15 and 16 has a gap G' that is larger than the gap G in the example of FIGS. 11 and 12. As best shown in FIG. 16, the nozzles 50 are not beyond the inner edge 36 of the walls 38.

Figure 17:
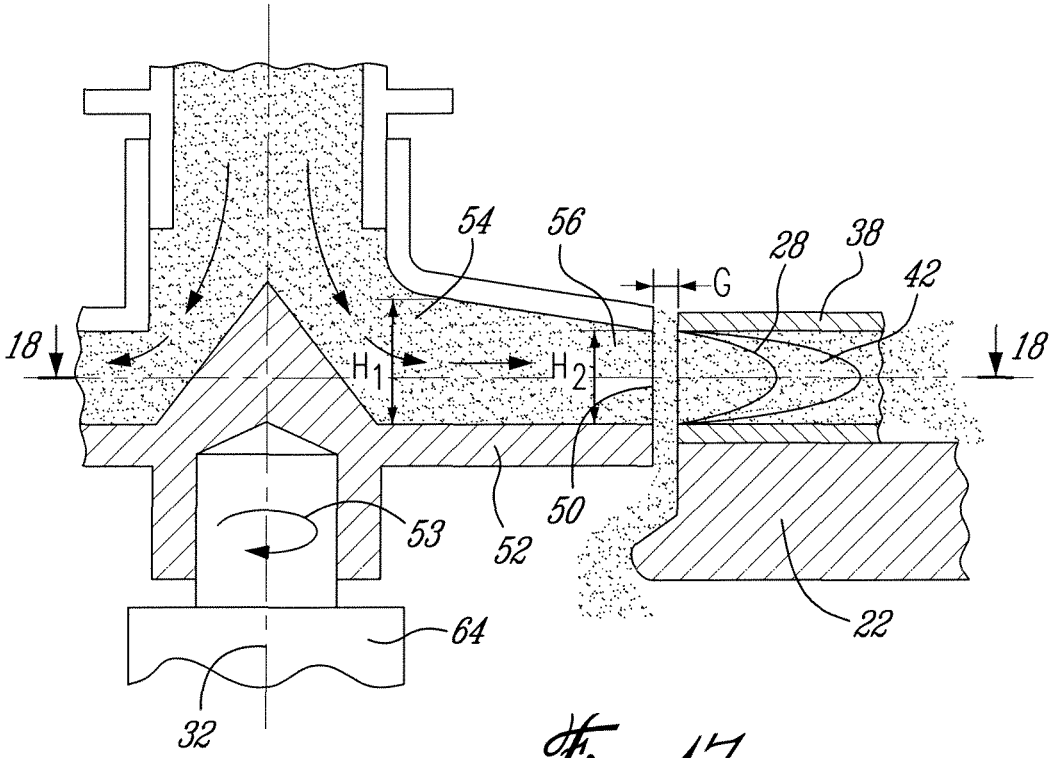
Figure 18:
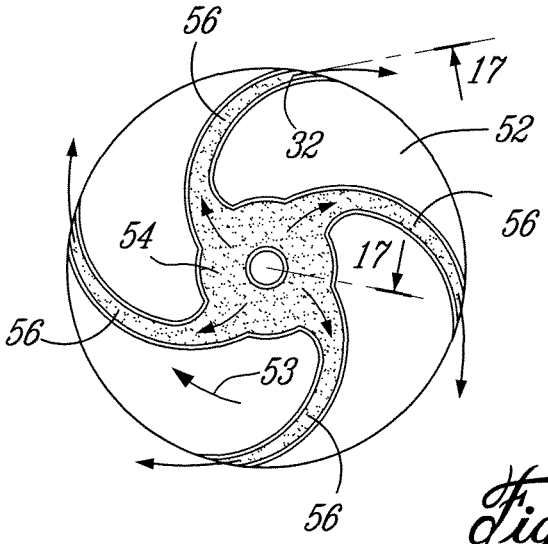

FIGS. 17 and 18 show a variant of the example shown in FIGS. 15 and 16. The configuration of the conduits 56 is similar to what is shown in the example of FIGS. 11 and 12.

Furthermore, it is possible to configure the system 48 with both a decrease in width and a decrease in height of the conduits 56, thereby combining the features of the conduits 56 in FIGS. 15 and 16 with those in FIGS. 17 and 18 to decrease the cross section of the conduits 56 along at least some of their length.

Overall, the above description is meant to be exemplary only, and one skilled in the art will recognize that changes may be made to what is described while still remaining within the same concept. The gas diffuser case can be different from the one shown and described herein. The tool head of the system can have more or less nozzles than what is shown and described herein. It is possible to omit the rough deburring in some instances, for example if the previous manufacturing process only leaves relatively small burrs or if large burrs can be easily removed by the stream of particles during the deburring. The method can include a plurality of sub-steps for the deburring. For instance, more than one kind of particles can be used successively. Still other modifications will be apparent to those skilled in the art, in light of a review of this disclosure, and such modifications are intended to fall within the scope of the appended claims.

What is claimed is:

1. A method of deburring channel inlet edges inside a cavity of a gas diffuser case, the diffuser case having a plurality of channels each having an inner surface and an inlet edge defining an inlet of the channel, the surfaces of adjacent channels co-operating to provide said inlet edge therebetween, the inlet edges of the channels being provided in an inwardly facing circular array around a central axis of the gas diffuser case, the method comprising:

inserting a tool head having at least one nozzle in an inward position relative to circular array of the channels of the gas diffuser case;

ejecting abrasive particles from the at least one nozzle from the inward position relative to the circular array, towards at least one of the channel inlet edges of the gas diffuser case and outwardly of the circular array, to deburr at least one said edge; and without removing the tool head from the inward position relative to the circular array of the channels, causing a relative rotation between the tool head and the circular array of channels to expose at least another of the channel inlet edges of the gas diffuser case to the abrasive particles.

2. The method as defined in claim 1, wherein the at least one nozzle is directed substantially coaxially with at least one of the channel inlet edges of the gas diffuser case.

3. The method as defined in claim 1, wherein the particles are wetted before being ejected.

4. The method as defined in claim 1, further comprising, before inserting the tool head in the cavity, removing burr pieces of at least some of the channel inlet edges exceeding a target profile.

5. The method as defined in claim 1, wherein the particles are ejected with a compressed carrier gas.

6. The method as defined in claim 1, wherein the tool is rotated and ejecting particles includes ejecting the particles at least partially by centrifugal effect.

7. The method as defined in claim 1, wherein the method includes repeatedly repositioning the at least one nozzle with reference to a remaining edge to thereby deburr all channel inlet edges of the gas diffuser case.

* * * * *